US006390551B1

(12) United States Patent
Hendrickson

(10) Patent No.: US 6,390,551 B1
(45) Date of Patent: May 21, 2002

(54) STORAGE AND CHAIR COMBINATION DEVICE

(76) Inventor: Lynn J. Hendrickson, 976 E. Claremont Dr., Bountiful, UT (US) 84010

( * ) Notice: Subject to any disclaimer, the term of this patent is extended or adjusted under 35 U.S.C. 154(b) by 0 days.

(21) Appl. No.: 09/775,433

(22) Filed: Feb. 2, 2001

(51) Int. Cl.[7] ..... A47D 1/10
(52) U.S. Cl. ..... 297/250.1; 297/188.08
(58) Field of Search ..... 297/250.1, 118, 297/188.01, 188.08, 188.09, 188.1, 183.5, 331, 335, 217.1, 352

(56) References Cited

U.S. PATENT DOCUMENTS 2,865,433 A 12/1958 Warner
3,594,039 A * 7/1971 Harp
4,556,250 A 12/1985 Chapman et al.
5,100,198 A 3/1992 Baltzell
D356,250 S 3/1995 Chang
5,573,288 A 11/1996 Raffensperger
5,580,125 A * 12/1996 Alger
5,722,717 A 3/1998 Rettenberger

* cited by examiner

*Primary Examiner*—Milton Nelson, Jr.

(57) ABSTRACT

A storage and chair combination device for storing, transporting and accessing various items while providing a seat which is positionable over and on a bleacher seat or stadium chair. The storage and chair combination device includes a housing having a bottom wall, a top wall, a back wall, and a pair of lateral side walls. A front side of the housing is open for accessing an interior of the housing. An interior of the housing has a plurality of intermediate horizontal and vertical walls such that a plurality of compartments are defined within the housing. A chair portion includes a seat panel comprising a resiliently flexible material. The seat panel has a size such that the seat panel substantially covers the front side of the housing when the seat panel is positioned over the front side of the housing. A securing member removably secures the chair to each of the lateral side walls. A coupling member rotatably couples a front edge of the seat panel to the housing such that the seat panel may be rotated away from the front side of the housing and positioned over a bleacher such that the housing is positioned below the bleacher.

9 Claims, 6 Drawing Sheets

STORAGE AND CHAIR COMBINATION DEVICE

BACKGROUND OF THE INVENTION

1. Field of the Invention

The present invention relates to storage and chair combination devices and more particularly pertains to a new storage and chair combination device for storing, transporting and accessing various items while providing a seat which is positionable over and on a bleacher seat or stadium chair.

2. Description of the Prior Art

The use of storage and chair combination devices is known in the prior art. More specifically, storage and chair combination devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,556,250; 2,865,433; 5,100,198; 5,573,288; 5,722,717; and 356,250.

While these devices fulfill their respective, particular objectives and requirements, the aforementioned patents do not disclose a new storage and chair combination device. The inventive device includes a housing having a bottom wall, a top wall, a back wall, and a pair of lateral side walls. A front side of the housing is open for accessing an interior of the housing. An interior of the housing has a plurality of intermediate horizontal and vertical walls such that a plurality of compartments are defined within the housing. A chair portion includes a seat panel comprising a resiliently flexible material. The seat panel has a size such that the seat panel substantially covers the front side of the housing when the seat panel is positioned over the front side of the housing. A securing member removably secures the chair to each of the lateral side walls. A coupling member rotatably couples a front edge of the seat panel to the housing such that the seat panel may be rotated away from the front side of the housing and positioned over a bleacher such that the housing is positioned below the bleacher.

In these respects, the storage and chair combination device according to the present invention substantially departs from the conventional concepts and designs of the prior art, and in so doing provides an apparatus primarily developed for the purpose of storing, transporting and accessing various items while providing a seat which is positionable over and on a bleacher seat or stadium chair.

SUMMARY OF THE INVENTION

In view of the foregoing disadvantages inherent in the known types of storage and chair combination devices now present in the prior art, the present invention provides a new storage and chair combination device construction wherein the same can be utilized for storing, transporting and accessing various items while providing a seat which is positionable over and on a bleacher seat or stadium chair.

The general purpose of the present invention, which will be described subsequently in greater detail, is to provide a new storage and chair combination device apparatus and method which has many of the advantages of the storage and chair combination devices mentioned heretofore and many novel features that result in a new storage and chair combination device which is not anticipated, rendered obvious, suggested, or even implied by any of the prior art storage and chair combination devices, either alone or in any combination thereof.

To attain this, the present invention generally comprises a housing having a bottom wall, a top wall, a back wall, and a pair of lateral side walls. A front side of the housing is open for accessing an interior of the housing. An interior of the housing has a plurality of intermediate horizontal and vertical walls such that a plurality of compartments are defined within the housing. A chair portion includes a seat panel comprising a resiliently flexible material. The seat panel has a size such that the seat panel substantially covers the front side of the housing when the seat panel is positioned over the front side of the housing. A securing member removably secures the chair to each of the lateral side walls. A coupling member rotatably couples a front edge of the seat panel to the housing such that the seat panel may be rotated away from the front side of the housing and positioned over a bleacher such that the housing is positioned below the bleacher.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new storage and chair combination device apparatus and method which has many of the advantages of the storage and chair combination devices mentioned heretofore and many novel features that result in a new storage and chair combination device which is not anticipated, rendered obvious, suggested, or even implied by any of the prior art storage and chair combination devices, either alone or in any combination thereof.

It is another object of the present invention to provide a new storage and chair combination device which may be easily and efficiently manufactured and marketed.

It is a further object of the present invention to provide a new storage and chair combination device which is of a durable and reliable construction.

An even further object of the present invention is to provide a new storage and chair combination device which is susceptible of a low cost of manufacture with regard to both materials and labor, and which accordingly is then susceptible of low prices of sale to the consuming public, thereby making such storage and chair combination device economically available to the buying public.

Still yet another object of the present invention is to provide a new storage and chair combination device which provides in the apparatuses and methods of the prior art some of the advantages thereof, while simultaneously overcoming some of the disadvantages normally associated therewith.

Still another object of the present invention is to provide a new storage and chair combination device for storing, transporting and accessing various items while providing a seat which is positionable over and on a bleacher seat or stadium chair.

Yet another object of the present invention is to provide a new storage and chair combination device which includes a housing having a bottom wall, a top wall, a back wall, and a pair of lateral side walls. A front side of the housing is open for accessing an interior of the housing. An interior of the housing has a plurality of intermediate horizontal and vertical walls such that a plurality of compartments are defined within the housing. A chair portion includes a seat panel comprising a resiliently flexible material. The seat panel has a size such that the seat panel substantially covers the front side of the housing when the seat panel is positioned over the front side of the housing. A securing member removably secures the chair to each of the lateral side walls. A coupling member rotatably couples a front edge of the seat panel to the housing such that the seat panel may be rotated away from the front side of the housing and positioned over a bleacher such that the housing is positioned below the bleacher.

Still yet another object of the present invention is to provide a new storage and chair combination device that has a second embodiment which may be used when the bleacher already has chairs having a back portion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
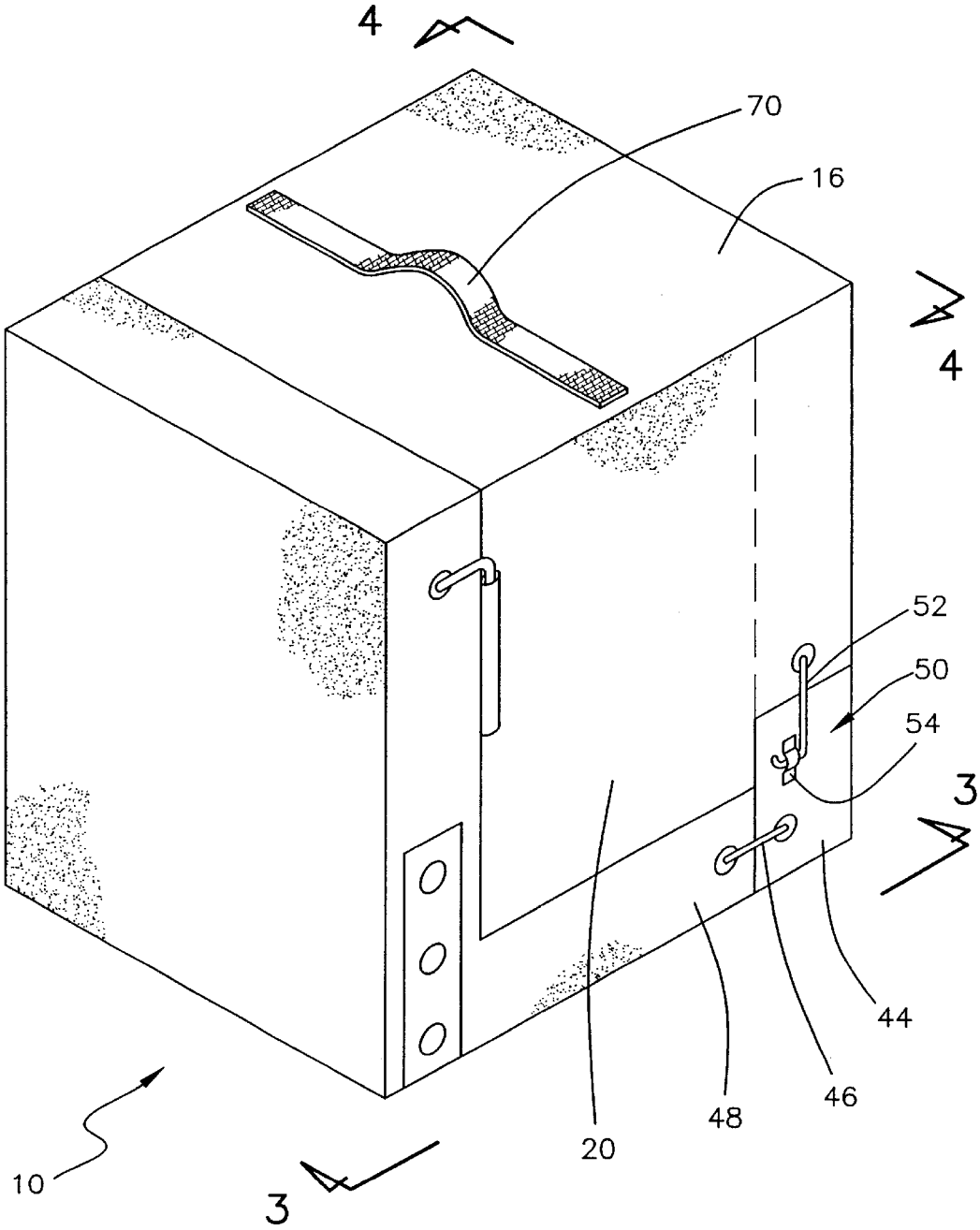
FIG. 1 is a schematic perspective view of a new storage and chair combination device according to the present invention.
Figure 2:
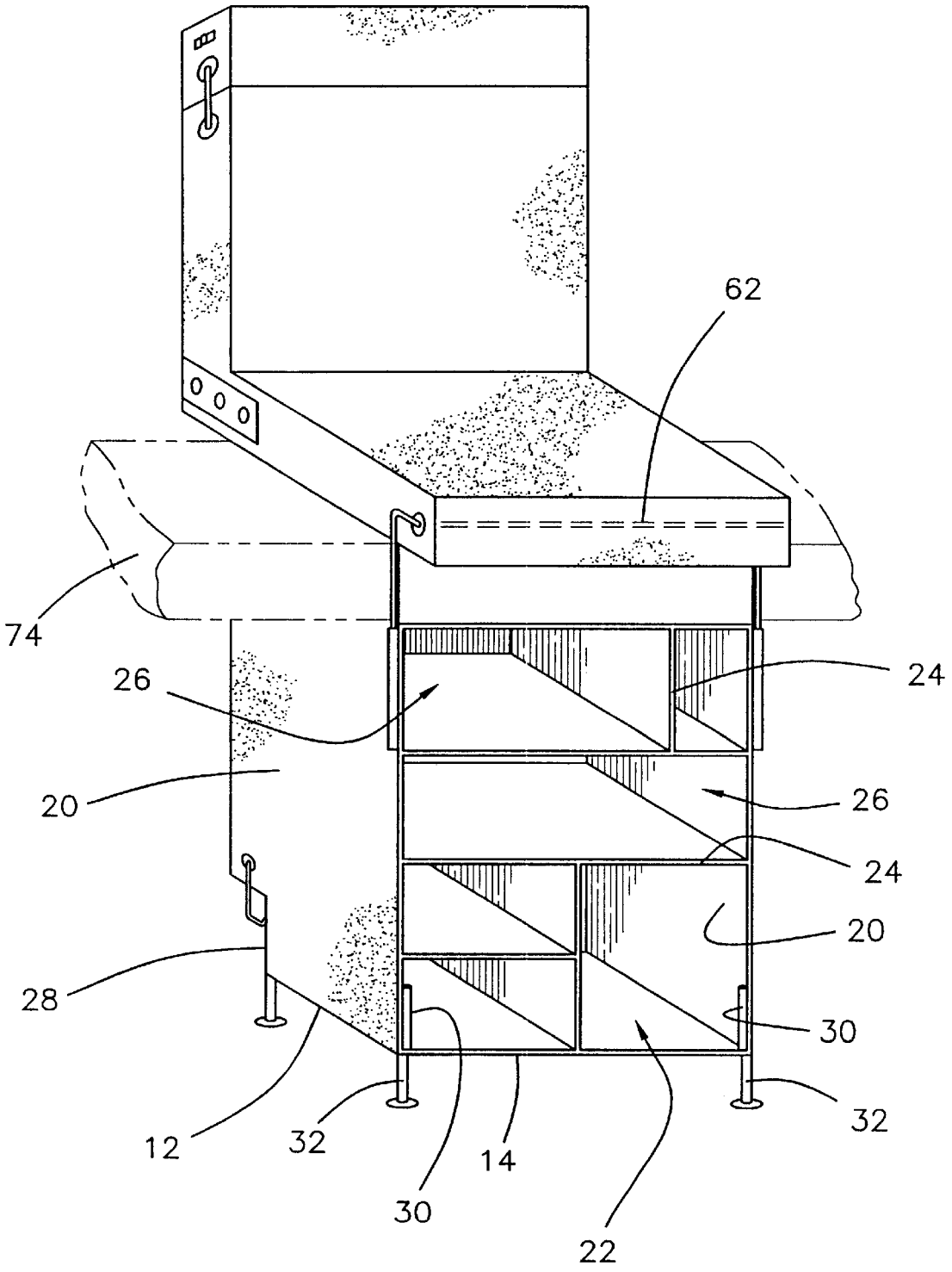
FIG. 2 is a schematic perspective in use view of the present invention.
Figure 3:
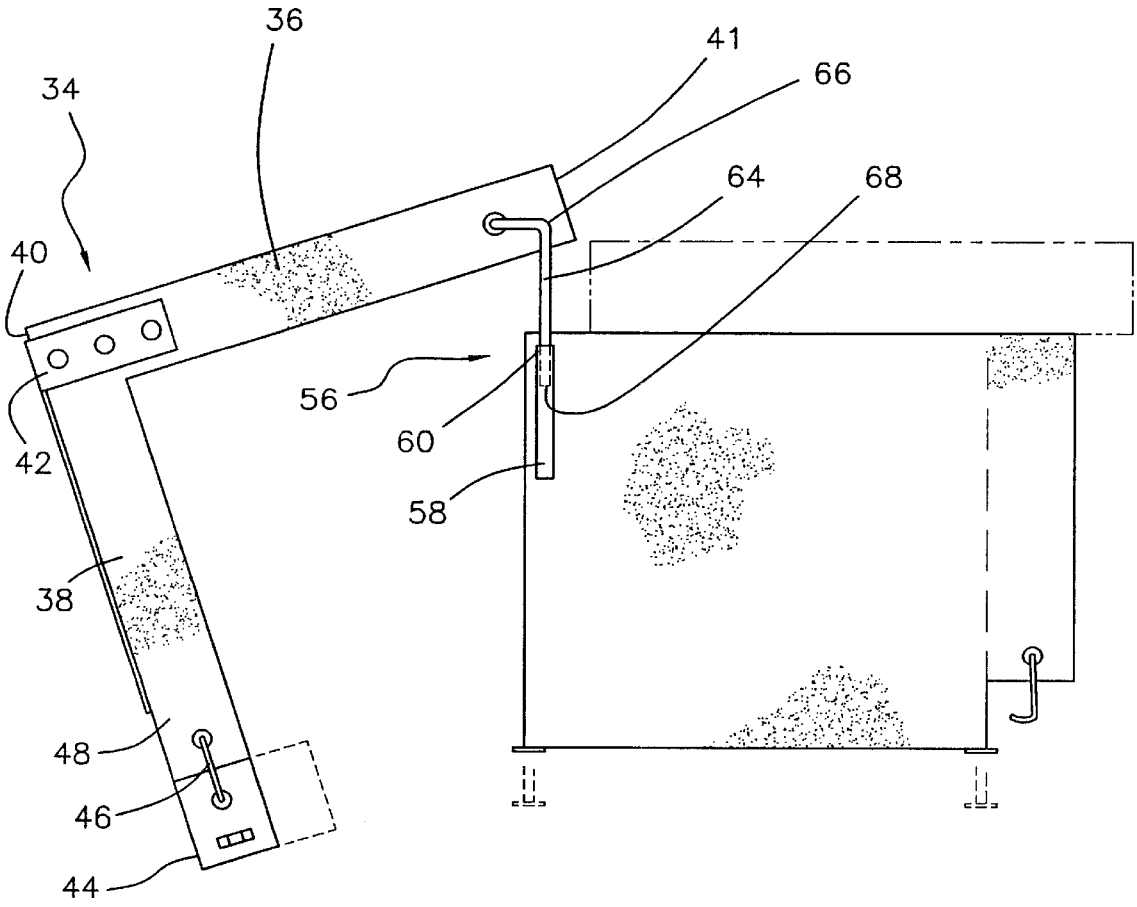
FIG. 3 is a schematic side view of the present invention.
Figure 4:
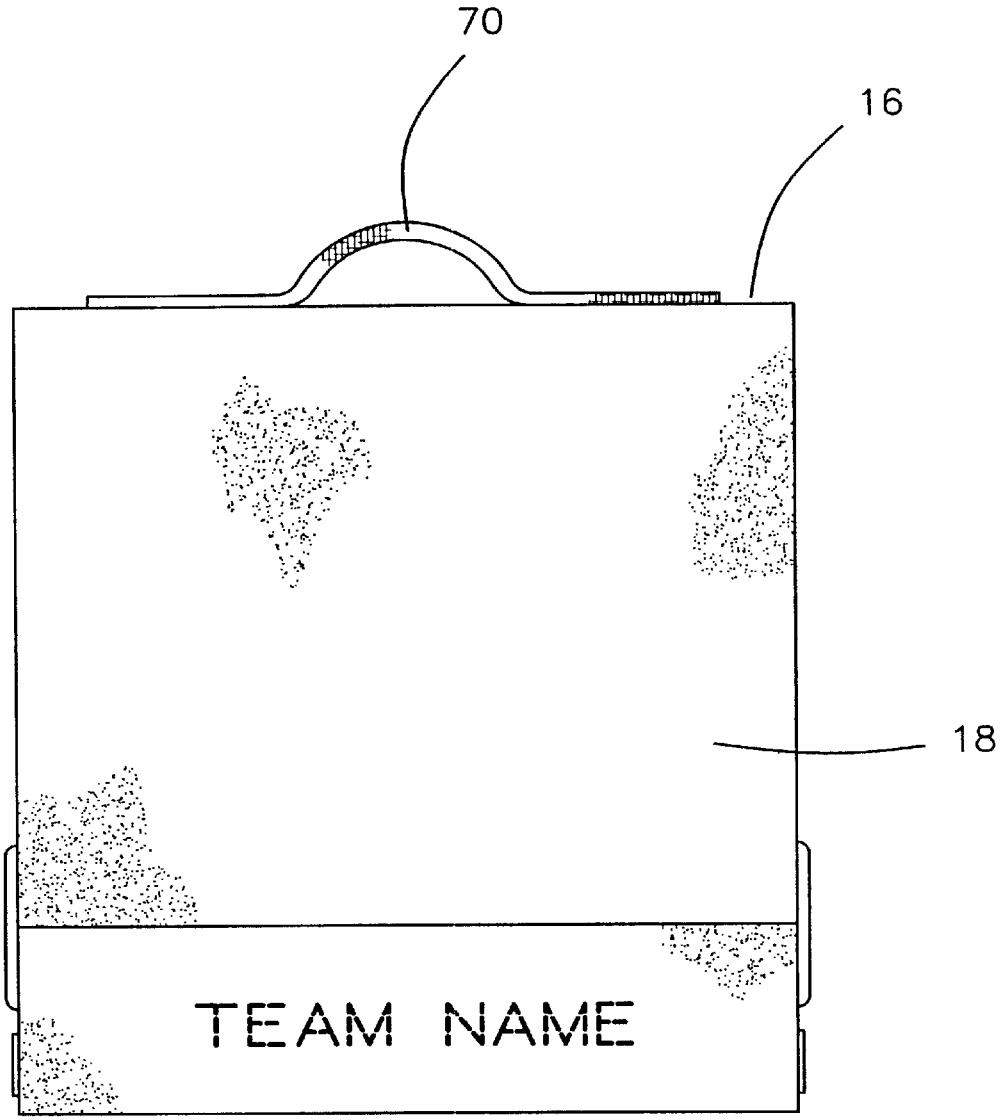
FIG. 4 is a schematic back view of the present invention.

With reference now to the drawings, and in particular to FIGS. 1 through 6 thereof, a new storage and chair combination device embodying the principles and concepts of the present invention and generally designated by the reference numeral 10 will be described.

As best illustrated in FIGS. 1 through 4, the storage and chair combination device 10 generally comprises a housing 12 having a bottom wall 14, a top wall 16, a back wall 18, and a pair of lateral side walls 20. A front side 22 of the housing 12 is open for accessing an interior of the housing. The bottom wall 14 has four corners. An interior of the housing 12 has a plurality of intermediate horizontal and vertical walls 24 such that a plurality of compartments 26 are defined within the housing 12. A notch 28 is in the housing 12 and extends along a length of a juncture of the bottom 14 and back 18 walls.

Each of a plurality of cylinders 30 is coupled to the bottom wall 14 and extends upwardly therefrom. Each of the cylinders 30 is positioned generally adjacent to one of the corners of the bottom wall 30. Each of a plurality of leg members 32 is removably extendable upwardly through the bottom wall 14 and into one of the cylinders 30 to support the housing above a ground surface.

A chair portion 34 includes a seat panel 36 comprising a resiliently flexible material such as dense elastomeric material. A back portion 38 is integrally coupled to and extends upwardly from a top surface of the seat panel 36. The back portion 38 is positioned generally adjacent to a back edge 40 of the seat panel 36. Metallic or plastic bracing members 42 may be used to further strengthen the bond between the back portion and the seat panel and insure that the back portion 38 remains in an upright position. The seat panel 36 has a size that the seat panel substantially covers the front side 22 of the housing 12 when the back portion 38 is abutting the bottom wall 14. The back portion 38 extends to a juncture of the notch 28 and the bottom wall 14.

A notch engaging portion 44 is coupled to back portion 38 by a pair of elastic members 46 positioned along a pair of lateral sides 48 of the back portion 38 such that the notch engaging portion 44 may be positioned in the notch 28.

A securing member 50 removably secures the chair 34 to each of the lateral side walls 20 and includes a pair of hook members 52 each being coupled to one of the side walls 20 of the housing 12 and being positioned adjacent to the notch 28. Each of a pair of loop members 54 is securely coupled to an opposite end of the notch engaging portion 44 and each is located such that each of the hook members 52 may releasably engage one of the loop members 54.

A coupling member 56 rotatably couples the chair portion 34 to the housing 12 and includes a pair of sleeves 58. Each of the sleeves 58 is generally tubular and is securely attached to one of the side walls 20 of the housing 12. Each of the sleeves 58 is positioned generally adjacent to the front side 22. Each of the sleeves 58 extends downward from the top wall 16 and each has a top end 60 having a hole therein. A U-shaped member has a middle portion 62 and a pair of legs 64. Each of the legs 64 has a bend 66 therein generally equal to ninety degrees such that each of legs 64 extend in the same direction. Each of the legs 64 has a free end 68 movably extendable into one of the holes in the sleeves 58 such that the middle portion 62 is positioned outwardly away from the front side 22. The middle portion 62 extends through the seat panel 36 and generally is positioned adjacent to a front edge 41 of the seat panel 36.

A handle 70 is securely attached to an outer surface of the top wall of the housing.

Figure 5:
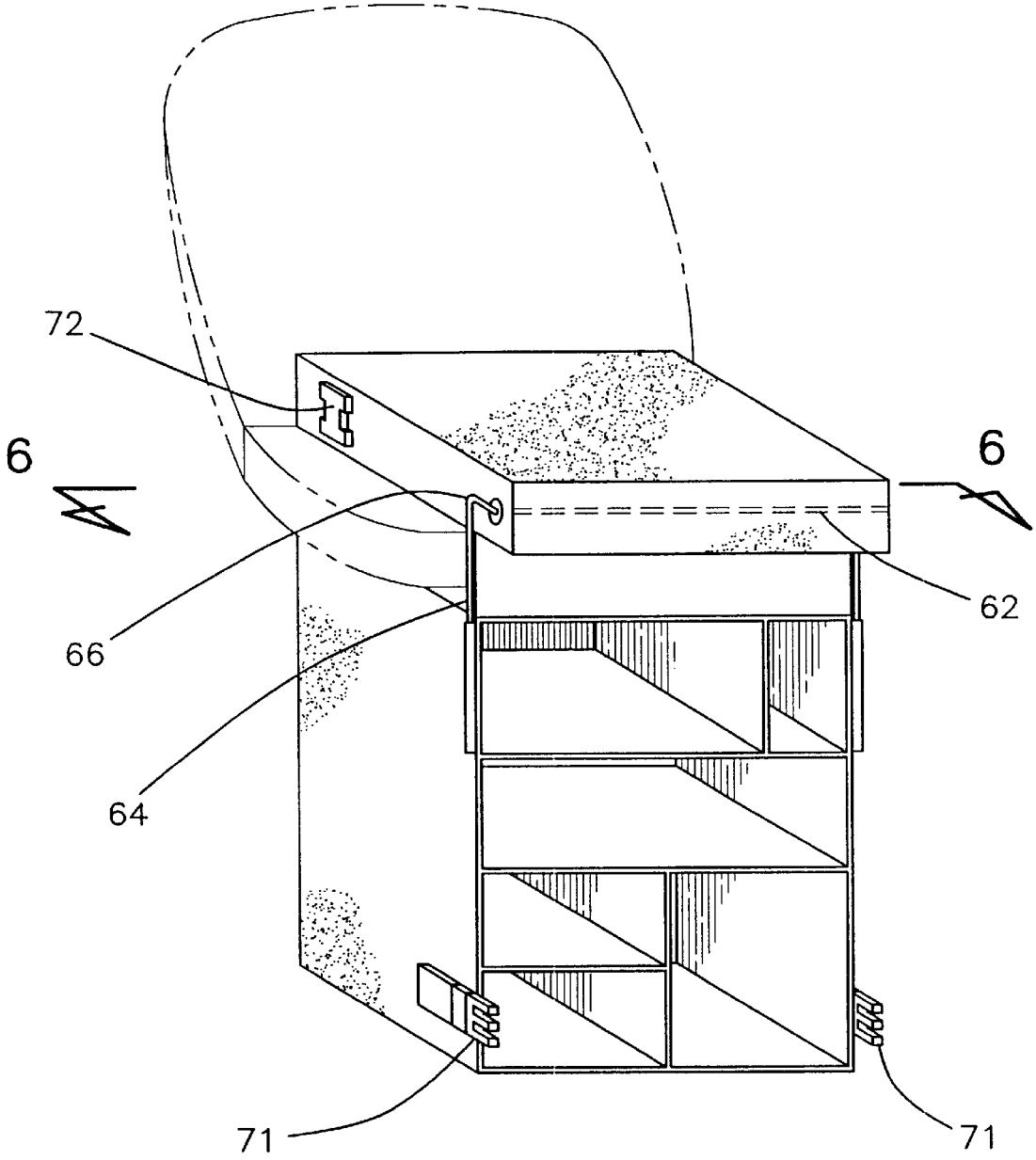
FIG. 5 is a schematic perspective view of the second embodiment of the present invention.
Figure 6:
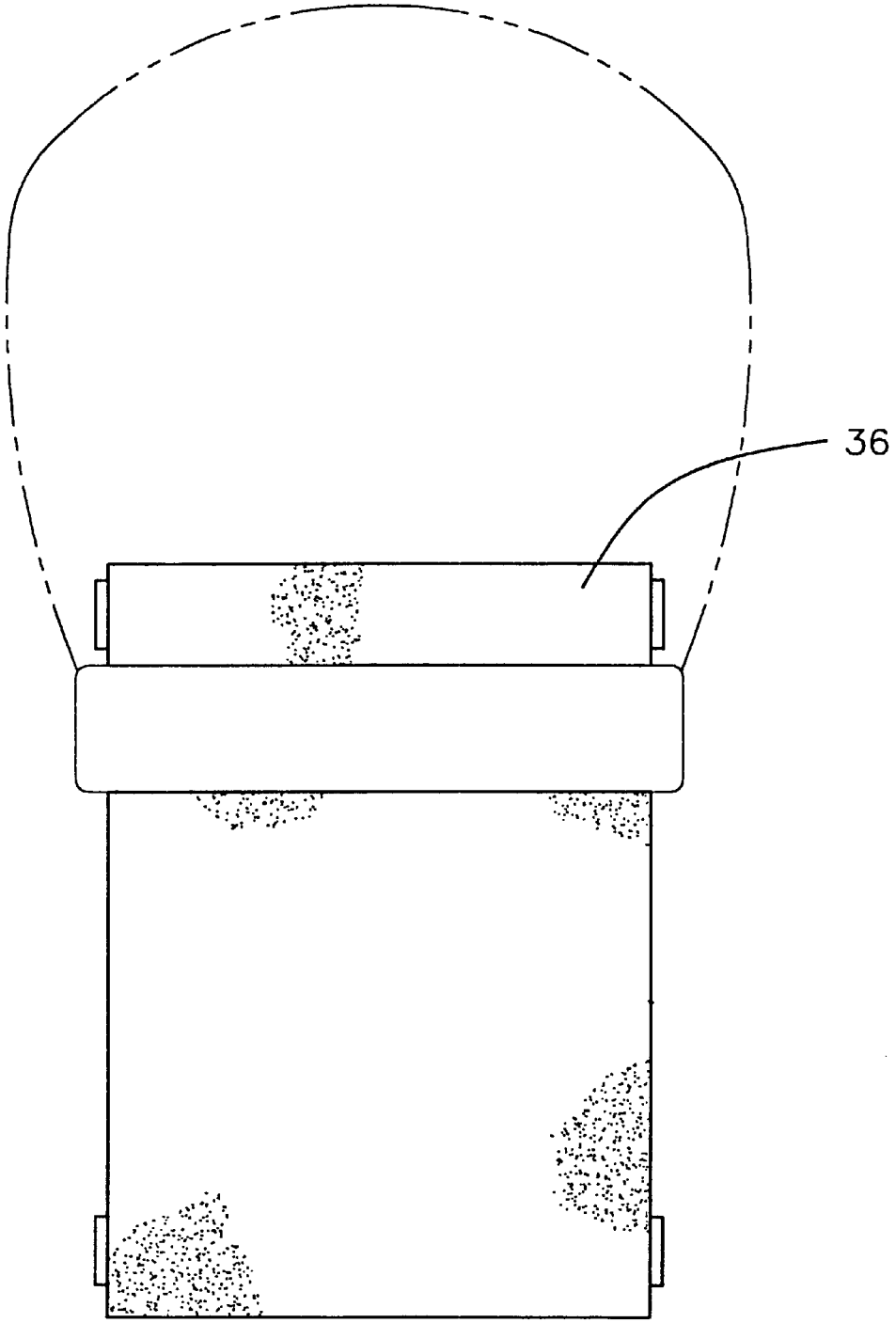
FIG. 6 is a schematic back view of the second embodiment of the present invention.

FIGS. 5 and 6 depict a second embodiment which does not have a back portion 38. The securing member 50 secured the seat panel 36 to the front side 22 of the housing 12 and includes a pair of male buckle portions 71 each being coupled to one of the side walls 20 of the housing 12 and being positioned adjacent to the front side 22 and the bottom wall 14. A pair of female buckle portions 72 each being securely coupled to one of a pair of lateral sides of the seat panel 36 and positioned to engage the male buckle portions 71. The bleacher 74 in FIG. 6 more accurately reflects a stadium chair already having a backrest portion.

In use, the chair 34 may be rotated away from the front side of the housing 20 and the seat panel 36 positioned on a bleacher 74 such that the back portion 38 extends upwardly away from the bleacher 74. This allows for access into the interior compartments 26 of the housing 12, which may hold a number of articles such as beverages, food and blankets.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination storage device and chair device, said device being removably positionable on a bleacher, said device comprising:

a housing having a bottom wall, a top wall, a back wall, and a pair of lateral side walls, a front side of said housing being open for accessing an interior of said housing, an interior of said housing having a plurality of intermediate horizontal and vertical walls such that a plurality of compartments are defined within said housing;

a chair portion includes;

a seat panel comprising a resiliently flexible material, said seat panel having a size such that said seat panel substantially covers said front side of said housing when said seat panel is positioned over said front side of said housing;

a securing member removably secures said chair portion to each of said lateral side walls; and a coupling member for rotatably coupling a front edge of said seat panel to said housing such that said seat panel may be rotated away from said front side of said housing and positioned over said bleacher such that said housing is positioned below said bleacher.

2. The combination storage device and chair device as in claim 1, further including:

said bottom wall having four corners; and a plurality of cylinders being coupled to said bottom wall and extending upwardly therefrom, each of said cylinders being positioned generally adjacent to one of said corners of said bottom wall, each of a plurality of leg members being removably extendable upwardly through said bottom wall and into one of said cylinders to support said housing above a ground surface.

3. The combination storage device and chair device as in claim 1, wherein said coupling member includes:

a pair of sleeves, each of said sleeves being generally tubular and being securely attached to one of said lateral side walls of said housing, each of said sleeves being positioned generally adjacent to said front side, each of said sleeves extending downward from said top wall and each having a top end having a hole therein; and a U-shaped member having a middle portion and a pair of legs, each of said legs having a bend therein generally equal to ninety degrees such that each of said legs extends in the same direction, each of said legs having a free end movably extendable into one of said holes in said sleeves such that said middle portion is positioned outwardly away from said front side, said middle portion extending through said seat panel and generally being positioned adjacent to said front edge of said seat panel.

4. The combination storage device and chair device as in claim 1, further including:

a back portion being integrally coupled to and extending upwardly from a top surface of said seat panel, said back portion being positioned generally adjacent to a back edge of said seat panel.

5. The combination storage device and chair device as in claim 4, wherein said coupling member includes:

a pair of sleeves, each of said sleeves being generally tubular and being securely attached to one of said lateral side walls of said housing, each of said sleeves being positioned generally adjacent to said front side, each of said sleeves extending downward from said top wall and each having a top end having a hole therein; and a U-shaped member having a middle portion and a pair of legs, each of said legs having a bend therein generally equal to ninety degrees such that each of said legs extends in the same direction, each of said legs having a free end movably extendable into one of said holes in said sleeves such that said middle portion is positioned outwardly away from said front side, said middle portion extending through said seat panel and generally being positioned adjacent to said front edge of said seat panel.

6. The combination storage device and chair device as in claim 4, further including:

a notch being in said housing and extending along a length of a juncture of said bottom and back walls, said back portion extending to a juncture of said notch and said bottom wall;

a notch engaging portion being coupled to said back portion by a pair of elastic members positioned along a pair of lateral sides of said back portion such that said notch engaging portion may be positioned in said notch.

7. The combination storage device and chair device as in claim 6, wherein said securing member includes:

a pair of hook members each being coupled to one of said lateral side walls of said housing and being positioned adjacent to said notch; and a pair of loop members, each of said loop members being securely coupled to an opposite end of said notch engaging portion and each being located such that each of said hook members may releasably engage one of said loop members.

8. The combination storage device and chair device as in claim 6, wherein said securing member includes:

a pair of male buckle portions each being coupled to one of said lateral side walls of said housing and being positioned adjacent to said front side and said bottom wall; and a pair of female buckle portions each being securely coupled to one of a pair of lateral sides of said seat panel and positioned to engage said male buckle portions.

9. A combination storage device and chair device, said device being removably positionable on a bleacher, said device comprising:

a housing having a bottom wall, a top wall, a back wall, and a pair of lateral side walls, a front side of said housing being open for accessing an interior of said housing, said bottom wall having four corners, an interior of said housing having a plurality of intermediate horizontal and vertical walls such that a plurality of compartments are defined within said housing, a notch being in said housing and extending along a length of a juncture of said bottom and back walls;

a plurality of cylinders being coupled to said bottom wall and extending upwardly therefrom, each of said cylinders being positioned generally adjacent to one of said corners of said bottom wall, each of a plurality of leg members being removably extendable upwardly through said bottom wall and into one of said cylinders to support said housing above a ground surface;

a chair portion includes;

a seat panel comprising a resiliently flexible material;

a back portion being integrally coupled to and extending upwardly from a top surface of said seat panel, said back portion being positioned generally adjacent to a back edge of said seat panel;

said seat panel having a size that said seat panel substantially covers said front side of said housing when said back portion is abutting said bottom wall, said back portion extending to a juncture of said notch and said bottom wall;

a notch engaging portion being coupled to said back portion by a pair of elastic members positioned along a pair of lateral sides of said back portion such that said notch engaging portion may be positioned in said notch;

a securing member for removably securing said chair portion to each of said lateral side walls includes;

a pair of hook members each being coupled to one of said lateral side walls of said housing and being positioned adjacent to said notch;

a pair of loop members, each of said loop members being securely coupled to an opposite end of said notch engaging portion and each being located such that each of said hook members may releasably engage one of said loop members;

a coupling member for rotatably coupling said chair portion to said housing, said coupling member including a pair of sleeves, each of said sleeves being generally tubular and being securely attached to one of said lateral side walls of said housing, each of said sleeves being positioned generally adjacent to said front side, each of said sleeves extending downward from said top wall and each having a top end having a hole therein;

a U-shaped member having a middle portion and a pair of legs, each of said legs having a bend therein generally equal to ninety degrees such that each of said legs extends in the same direction, each of said legs having a free end movably extendable into one of said holes in said sleeves such that said middle portion is positioned outwardly away from said front side, said middle portion extending through said seat panel and generally being positioned adjacent to a front edge of said seat panel;

a handle being securely attached to an outer surface of said top wall of said housing;

wherein said chair may be rotated away from said front side of said housing and said seat panel positioned on said bleacher such that said back portion extends upwardly away from said bleacher.

* * * * *